US008436704B1

(12) United States Patent
Venkataraghavan et al.

(10) Patent No.: US 8,436,704 B1
(45) Date of Patent: May 7, 2013

(54) PROTECTED POWDER METAL STATOR CORE AND SOLENOID ACTUATOR USING SAME

(75) Inventors: Jayaraman K. Venkataraghavan, Dunlap, IL (US); Saboor Sheikh, Dunlap, IL (US); Daniel Richard Ibrahim, Metamora, IL (US); Michael C. Long, Metamora, IL (US); Nadeem N. Bunni, Cranberry Township, PA (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/292,163

(22) Filed: Nov. 9, 2011

(51) Int. Cl.
*H01F 3/00* (2006.01)
*H01F 7/08* (2006.01)

(52) U.S. Cl.
USPC ..... 335/281; 335/220; 251/129.15

(58) Field of Classification Search ..... 335/220–229, 335/281; 251/129.15
See application file for complete search history.

(56) References Cited

U.S. PATENT DOCUMENTS 4,583,509 A * 4/1986 Schechter et al. ..... 123/451
5,127,585 A 7/1992 Mesenich
5,782,411 A 7/1998 Potter
5,939,811 A 8/1999 Enomoto et al.
6,105,931 A 8/2000 Frank et al.
7,075,394 B2 * 7/2006 Matsusaka et al. ..... 335/80
7,273,186 B2 9/2007 Kubo et al.
2005/0189510 A1 * 9/2005 Golovatai-Schmidt et al. ..... 251/129.15
2006/0113503 A1 * 6/2006 Mennicken et al. ..... 251/129.15
2009/0267008 A1 10/2009 Lucas et al.
2009/0278067 A1 * 11/2009 Voss ..... 251/129.15

* cited by examiner

*Primary Examiner* — Bernard Rojas
(74) *Attorney, Agent, or Firm* — Liell & McNeil

(57) ABSTRACT

A solenoid actuator includes a stator assembly with a stator core of formed powder metal received in a stator housing. A ferromagnetic protective sleeve is in contact with and covers a majority of an inner end face and a cylindrical wall of the stator core, while a flux ring is in contact with and covers an outer end face of the stator core. An armature assembly includes an armature attached to a stem that is movable in an air gap relative to the ferromagnetic protective sleeve. A spring is operably positioned in the ferromagnetic protective sleeve but electrically isolated from the stator housing. The stator core is encapsulated to protect against erosion and fragmentation. A magnetic flux line around a solenoid coil passes through the stator core, the ferromagnetic protective sleeve, the armature, the flux ring and back to the stator core.

20 Claims, 3 Drawing Sheets

PROTECTED POWDER METAL STATOR CORE AND SOLENOID ACTUATOR USING SAME

TECHNICAL FIELD

The present disclosure relates generally to solenoid actuators, such as those used for fuel injector applications, and more particularly to a multi-functional ferromagnetic protective sleeve for a solenoid stator assembly utilizing a powder metal stator core.

BACKGROUND

Solenoid actuators are widely used in fuel injectors to move a control valve(s) to precisely control fluid connections within the fuel injector in order to control injection timing and injection quantities. As performance demands have crept upward, the industry has continued to seek new materials and assembly options to improve upon existing solenoid actuators. One strategy that has shown promise for improving performance includes utilizing soft powder metal in forming the stator core of the solenoid actuator. This material is known for exhibiting better magnetic permeability characteristics than ferromagnetic alloy counterparts. Unfortunately, the bonds between individual particles of powder in the stator core are weak, thus creating new potential problems with regard to erosion and fragmentation. This liberated powder material not only degrades the solenoid actuator performance, but can also lead to injector failure by particle debris inhibiting movement of various components and potentially blocking nozzle outlets of the fuel injector.

U.S. Patent publication 2009/0267008 teaches a solenoid actuator that uses a powder metal stator core that is partially plated with non-ferrous material to inhibit breakage and loss of powder particles during assembly and use. While the '008 patent publication teaches a strategy for protecting most of the powder metal stator core from fragmentation and loss of particles, the reference teaches an intentional exposure of the soft powder metal surface in the air gap region between the stator assembly and armature where fuel resides and swirls around with each actuation of the actuator, when in use. Thus, the '008 publication still teaches a structure with soft powder metal core directly in contact with moving fuel over the working life of the fuel injector, which may lead to erosion, degraded performance and potential failure by liberated powder particles lodging in critical locations within the fuel injector. Furthermore, while this reference teaches a strategy for protecting much of the soft powder metal stator core from breakage, it teaches the use of a non-ferromagnetic plating, which results in valuable space that could be used to carry magnetic flux instead being occupied by a protective plating that does not contribute to supporting the magnetic field.

The present disclosure is directed toward one or more of the problems set forth above.

SUMMARY OF THE DISCLOSURE

In one aspect, a solenoid stator assembly includes a housing that defines an inner cavity that opens through one end along a centerline. A stator core of formed powder metal is fitted completely into the inner cavity and includes an inner end face contiguous to a cylindrical wall concentric with the centerline. A ferromagnetic protective sleeve has a surface in contact with the inner end face and cylindrical wall of the stator core. A flux ring is positioned in the housing in contact with an outer end face of the stator core. The solenoid coil is wound on a bobbin and positioned in the housing and surrounded by the stator core. A magnetic flux line around the coil passes through the stator core, the ferromagnetic protective sleeve and the flux ring.

In another aspect, a solenoid actuator includes a stator assembly with a stator core of formed powder metal received in a stator housing, a ferromagnetic protective sleeve in contact with and covering a majority of an inner end face and a cylindrical wall of the stator core, a flux ring in contact with and covering an outer end face of the stator core, and a solenoid coil surrounded by the stator core. An armature assembly includes an armature attached to a stem and movable between an initial air gap and a final air gap relative to the ferromagnetic protective sleeve. A spring is operably positioned in the ferromagnetic protective sleeve but electrically isolated from the stator housing. A magnetic flux line around the coil passes through the stator core, the ferromagnetic protective sleeve, the armature, the flux ring and back to the stator core.

In still another aspect, a method of assembling a solenoid actuator includes fitting a cylinder of a ferromagnetic protective sleeve into a central bore of a stator core of formed powder metal until a disk of the ferromagnetic protective sleeve contacts an inner end face of the stator core. An armature biasing spring is electrically isolated from a stator housing the stator core and an electrical isolation cavity separating the ferromagnetic protective sleeve from contact with the stator housing. An outer end face of the stator core is covered with a flux ring. The solenoid actuator is configured so that a magnetic flux line around the coil passes through the stator core, the ferromagnetic protective sleeve, the armature, the flux ring and back to the stator core.

DETAILED DESCRIPTION

Figure 1:
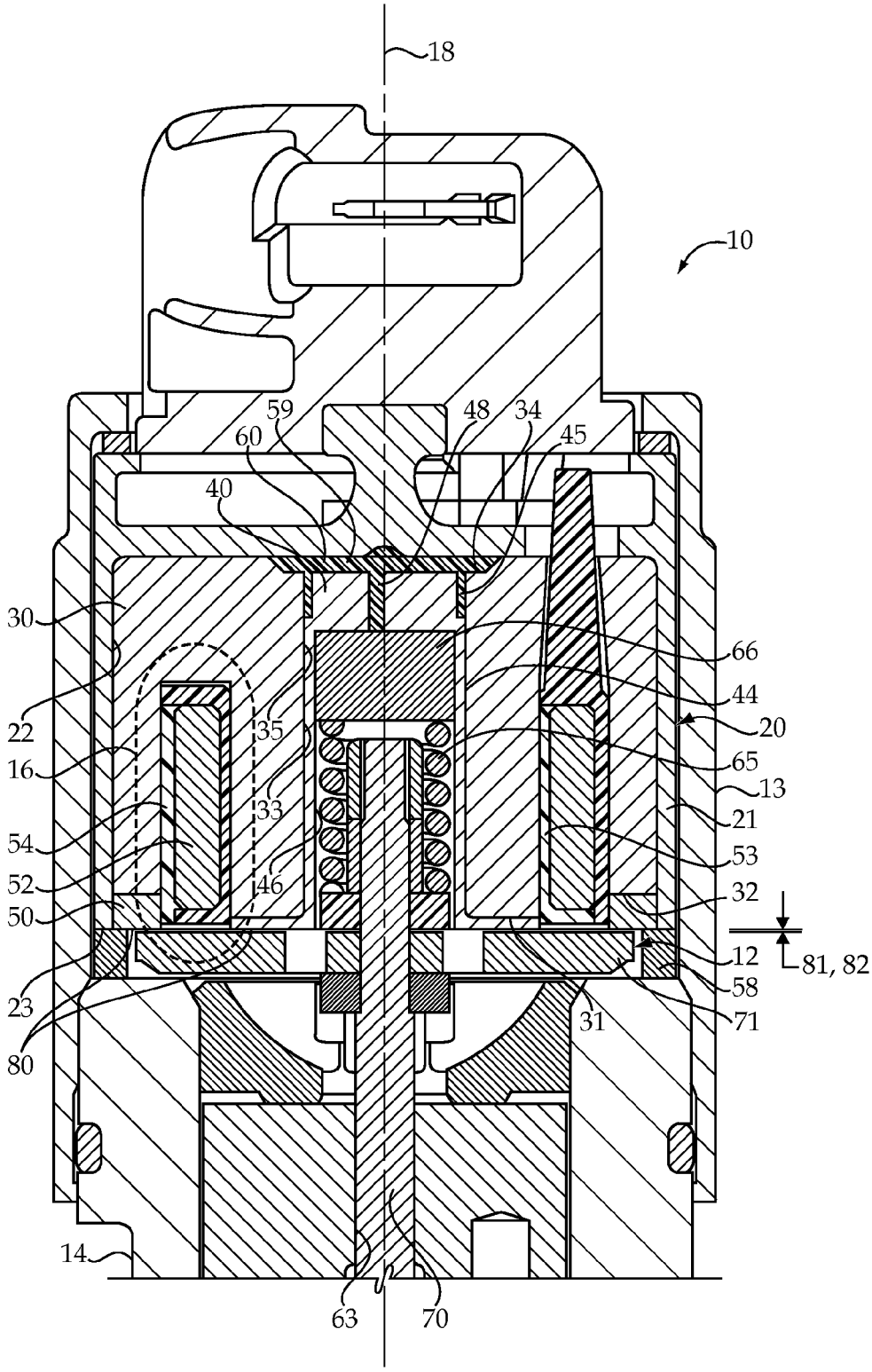
FIG. 1 is a sectioned front view of a solenoid actuator according to the present disclosure.

Referring to FIG. 1, a solenoid actuator 10 is illustrated as it might appear in a top half of a common rail fuel injector for an electronically controlled compression ignition engine. Solenoid actuator 10 includes a stator assembly 20 and an armature assembly 12 that are located inside an actuator housing 13 and body 14. Armature assembly 12 is normally biased downward away from stator assembly 20 by a biasing spring 65. When the coil 52 of the stator assembly 20 is energized, magnetic flux lines are generated around coil 52 to attract armature assembly 12 toward stator assembly 20. Armature assembly 12 moves from an initial air gap 81 to a final air gap 82, and the travel distance corresponding to the distance between these two air gaps may be so small as to be barely visible in the illustration of FIG. 1. Nevertheless, armature assembly 12 does not make contact with stator assembly throughout its travel from the initial air gap 81 to final air gap 82.

Armature assembly 12 includes an armature 70 that is attached to a stem 71. Armature 70 is typically made from a soft ferromagnetic alloy material chosen more for its magnetic permeability verses other considerations, such as wear characteristics and resistance to impact. As stated earlier, throughout operation, the armature 70 preferably makes no impact or sliding contact with any other components of solenoid actuator 10. Stem 71 may be chosen from harder alloys with more emphasis on wear resistance and impact resistance, as the stem 71 may impact stops (not shown) when armature assembly moves between an initial air gap 81 and a final air gap 82. For instance, stem 71 may include valve surfaces that are trapped to move between conical valve seats, with that travel distance between the valve seats corresponding to the travel distance between the initial air gap 81 and the final air gap 82.

Body 14 may be threadably attached to actuator housing 13 to compress an air gap spacer 58 between stator assembly 20 and body 14. Thus, air gap spacer 58 is in contact with both stator assembly 20 and body 14, and may be a category part with numerous slightly different heights to choose from so that the initial and final air gap 81 and 82 may be chosen by selecting an appropriate height air gap spacer 58 in a known manner. In addition, armature assembly 12, and stem 71 specifically, may be guided in movement along centerline 18 by the stem 71 being received in, and guided in, a guide bore 63 defined by body 14. Those skilled in the art will appreciate that body 14 may be a combination of separate components that are affixed to one another in a known manner.

Solenoid stator assembly 20 includes a stator housing 21 that defines an inner cavity 22 that opens through one end 23 along centerline 18. A stator core 30 of formed powder metal is fitted completely into the inner cavity 22, and includes an inner end face 31 contiguous to a cylindrical wall 33 that is concentric with centerline 18. The cylindrical wall 33 may define a central bore 35 extending completely through stator core 30 along centerline 18. The central bore 35 may flare at the top end of stator core 30 to include a retention ledge 34 that surrounds centerline 18. Stator core 30 may be formed from powder metal into the shape shown using conventional techniques known in the art.

A ferromagnetic protected sleeve 40 is positioned in central bore 35 and includes a surface 44 in contact with the inner end face 31 and cylindrical wall 33 of stator core 30. Surface 44 may cover a majority or all of inner end face 31 and most of cylindrical wall 33. In one specific embodiment, ferromagnetic protective sleeve will completely cover inner end face 31 and completely cover a segment of cylindrical wall 33 that is contiguous with inner end face 31. Alternatively, ferromagnetic protective sleeve 40 may define a slot 48 running its complete length so that the ferromagnetic protective sleeve 40 can be slightly elastically deformed when being fitted into position within cylindrical bore 35, and kept in place in part with a frictional interaction with cylindrical wall 33 of stator core 30. Preferably, ferromagnetic protective sleeve 40 is separated from contact with stator housing 21 by an electrical isolation cavity 60 that is defined by stator core 30, stator housing 21 and a top portion of ferromagnetic protective sleeve 40. As an additional strategy for maintaining ferromagnetic protective sleeve 40 affixed to stator core 30, electrical isolation cavity 60 may be filled with plastic 59 that is molded into contact with retention ledge 34 of stator core 30 and an annular knurled surface 45 on ferromagnetic protective sleeve 40. Those skilled in the art will appreciate that ferromagnetic protective sleeve 40 may be electrically isolated from stator housing 21 not only by the separation distance provided by electrical isolation cavity 60, also by the poor electrical conductivity of the powder metal that makes up stator core 30, which is in contact with stator housing 21. Ferromagnetic protective sleeve 40 is not formed of powder metal, but is formed from a ferromagnetic material that is a suitable alloy that responds well to grinding and other machining operations without fragmenting, but retains a good magnetic permeability so as to function as a portion of the stator for solenoid actuator 10. Since ferromagnetic protective sleeve 40 is not a movable component and nor does it experience impacts during its working life, ferromagnetic protective sleeve may be formed from a suitable soft ferromagnetic alloy, which is in contrast to the relatively harder material that might be associated with stator housing 21 or stem 71. Finally, ferromagnetic protective sleeve 40 may define a central cavity 46 that is concentric with centerline 18.

A flux ring 50, which may be made from a material similar to that of ferromagnetic protective sleeve 40, is positioned in stator housing 21 in contact with, and preferably completely covering, an outer end face 32 of stator core 30. Thus, flux ring also carries magnetic flux and performs the function of protecting the outer end face 32 of stator core 30 from erosion and fragmentation during assembly and when in use after installation. After being properly positioned, the end 23 of stator housing 21, flux ring 50 and ferromagnetic protective sleeve 40 may be ground to be flush to define a planar air gap surface 80 oriented perpendicular to centerline 18.

The solenoid stator assembly 20 also includes a solenoid coil 52 wound on a bobbin 53 and positioned in stator housing 21 surrounded by stator core 30. Although not necessary, solenoid coil 52 may be completely enclosed by bobbin 53 and a bobbin overmold 54. When coil 52 is energized, magnetic flux lines 16 encircle the coil. Some of those magnetic flux lines pass through stator core 30, ferromagnetic protective sleeve 40, armature 70, flux ring 50 and back to stator core 30. Only one magnetic flux line 16 is shown to avoid obscuring structural features of solenoid actuator 10.

An armature biasing spring 65 may be positioned in ferromagnetic protective sleeve 40, but electrically isolated from stator housing 21. Spring 65 may be in contact along its side with ferromagnetic protective sleeve 40, but electrical isolation cavity 60 and the poor conductivity of stator core 30 electrically isolate spring 65 from stator housing 21. Electrical isolation of spring 65 from stator housing 21 may be desirable because energization of solenoid coil 52 may induce a voltage in a potential circuit that could include spring 65, stator housing 21, body 14, stem 71 and armature 70. If this circuit is closed, arcing across a valve seat to the valve member (not shown) can cause premature material erosion and degradation at the valve seat (not shown). Thus, in those applications where this induced voltage and potential arcing problem is not an issue, electrical isolation of ferromagnetic protective sleeve 40 from stator housing 21 is of a lesser concern. The preload on armature biasing spring 65 may be determined by a spring preload spacer 66 that is in contact with ferromagnetic protective sleeve 40 and spring 65 within central cavity 46 of sleeve 40.

In order to inhibit virtually any fragmentation or erosion of stator core 30, it may be encapsulated by at least stator housing 21, flux ring 50, bobbin 53, bobbin overmold 54 and ferromagnetic protective sleeve 40. Maybe of most concern would be protecting against fluid erosion at inner end face 31 and protecting against abrasion by spring 65 by rubbing against cylindrical wall 33. As used in this disclosure, the term "encapsulated" means that the stator core does not have significant exposed surfaces from which powder metal may fragment or erode and enter into the fuel that circulates through and generally surrounds armature 70. For instance, the area around armature 70 may be at low pressure and connected to a fluid drain in the case of a fuel injector, but that fuel may be eventually recirculated, pressurized and injected. That fuel circulation process could be undermined by the presence of solids, such as powder metal, suspended in the fuel.

Figure 2:
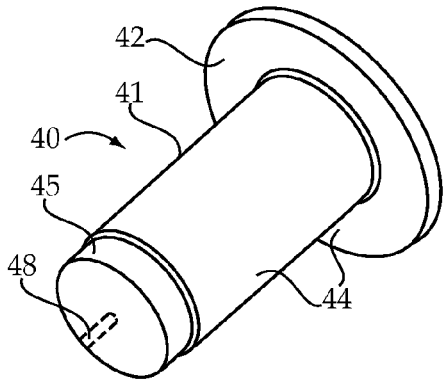
FIG. 2 is an isometric view of a ferromagnetic protective sleeve according to another aspect of the present disclosure.
Figure 3:
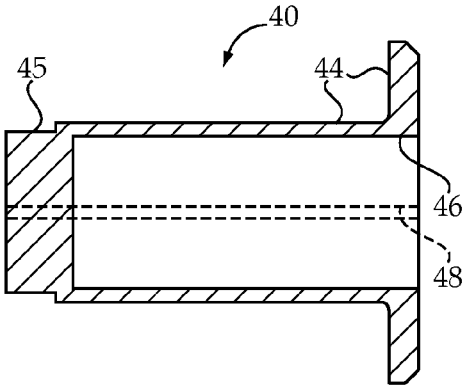
FIG. 3 is a sectioned side view of the ferromagnetic protective sleeve of FIG. 2.
Figure 4:
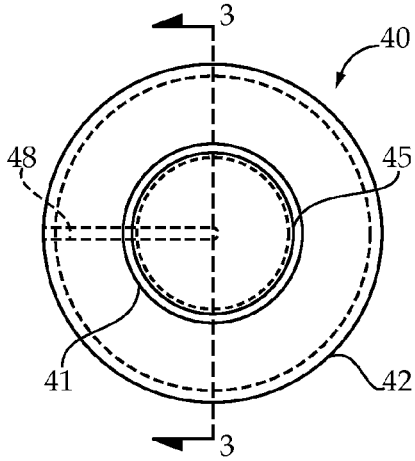
FIG. 4 is a top view of a ferromagnetic magnetic protective sleeve shown in FIG. 2.

As best shown in FIGS. 2-4, ferromagnetic protective sleeve 40 may have a stovepipe top hat shape that includes a cylinder 41 and a disk 42. Ferromagnetic protective sleeve may be equipped with a slot 48 to produce spring action in assembling the same to stator core 30. Inclusion of the slot 48 may also reduce eddy currents when solenoid actuator 10 is operating. On the other hand, the inclusion of slot 48 may leave an open exposed surface of stator core 30 that may complicate assembly by the need to fill the gap, such as with plastic, after the components are positioned as shown in FIG. 1 to encapsulate the stator core 30. Thus, the inclusion of slot 48 may incrementally improve response time of solenoid actuator 10, but complicate manufacturing, rendering the inclusion or emission of slot 48 as a design choice. In all cases, ferromagnetic protective sleeve 40 will have no moving components, and will be preferably an integral unitary body of some appropriate ferromagnetic alloy shaped to include the features shown and described.

Figure 5:
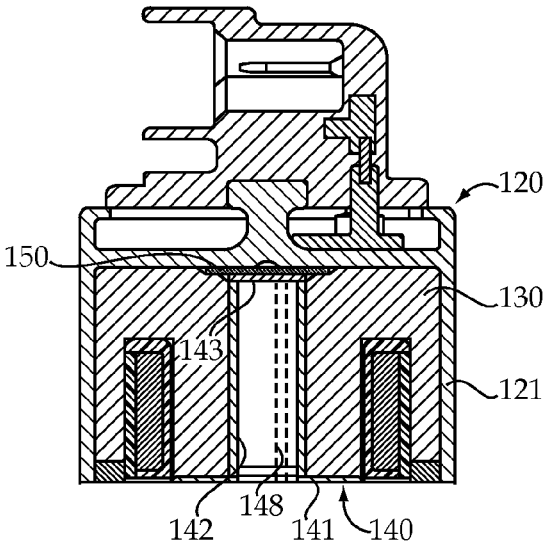
FIG. 5 is a sectioned side view of another embodiment of a stator assembly according to the present disclosure.

Referring now to FIG. 5, an alternative embodiment of a solenoid stator assembly 120 according to the present disclosure differs slightly in the construction and shape of the ferromagnetic protective sleeve 140 relative to the previously described embodiment, in that it includes an alternative strategy for helping to electrically insulate the sleeve 140 from stator housing 121. In this embodiment, ferromagnetic protective sleeve 140 may include a hollow cylinder 142 with a washer shaped component 141 affixed to one end and a small disk 143 affixed to its opposite end. The separate elements 141, 142, 143 may be joined in any suitable manner, such as by welding, or may be made by forming a unitary body into the shape shown. In addition, the ferromagnetic protective sleeve 140 may include a slot 148 to help reduce eddy currents and maybe provide a spring effect when installing the sleeve into stator core 130, which is also a formed of powder metal in need of being protected. In this case, electrical isolation may be accomplished by including a ceramic disk 150 in the space between ferromagnetic protective sleeve 140 and the inner surface of stator housing 121.

Figure 6:
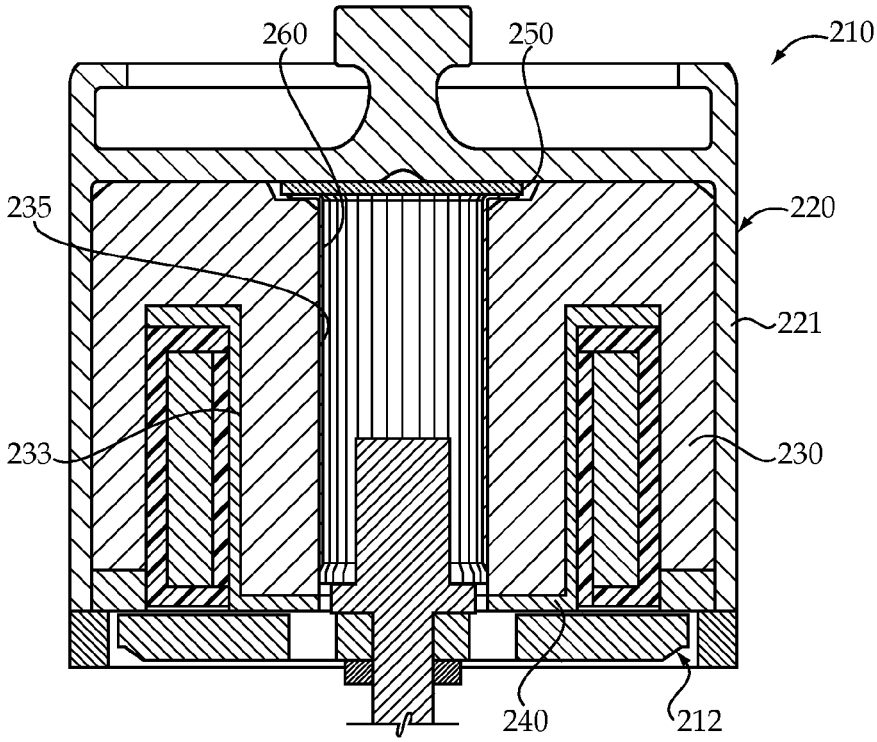
FIG. 6 is a sectioned side view of a solenoid actuator according to still another embodiment of the present disclosure.
Figure 7:
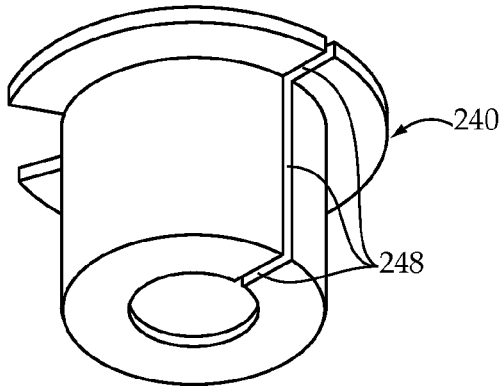
FIG. 7 is an isometric view of a ferromagnetic protective sleeve from the embodiment of FIG. 6.

Referring now to FIGS. 6 and 7, still another alternative embodiment of a solenoid actuator 10 includes a stator assembly 220 and an armature assembly 212. This embodiment differs from the earlier embodiments in that the ferromagnetic protective sleeve 240 protects a cylindrical wall 233, which is not a portion of a central bore 235. In addition, this embodiment differs by the inclusion of a stainless steel liner 235 to protect against fragmentation and rubbing by an armature biasing spring (not shown) that might otherwise rub against the cylindrical wall that defines a central bore 235. A ceramic disk 250 may separate stainless steel liner 260 from the stator housing 221 to provide electrical isolation as discussed earlier. As best shown in FIG. 7, the ferromagnetic protective sleeve 240 may include a slot 248 that may serve to reduce eddy currents and may better facilitate attachment to stator core 230, which like the earlier embodiments is formed of a powder metal with high magnetic permeability.

INDUSTRIAL APPLICABILITY

Solenoid actuators 10, 210 in general and stator assemblies 20, 120 and 220 in particular can find potential application in any high speed, high performance solenoid actuator that utilizes a powder metal core that is potentially at risk of fragmenting or eroding during the useful life of the actuator. The present disclosure defines specific applicability in controlling valves in a fuel injector for a compression ignition engine.

Several subtle but important considerations can influence the manufacturability, the ease of assembly and the performance of a solenoid actuator according to the present disclosure. Utilizing a stator that is predominantly powder metal provides potential performance advantages over known soft magnetic alloys, but does so at the risk of potential fragmentation and erosion that can undermine performance of the actuator this may put at risk the fuel injector if debris finds its way into critical areas, such as sliding components and/or in nozzle outlets. This potential problem of fragmentation and erosion is addressed in the present disclosure, at least partially with the inclusion of a multi-function ferromagnetic protective sleeve 40, 140, 240. The ferromagnetic protective sleeve is preferably made from a material that acts as part of the stator by carrying flux, but has other attributes not realistically possible from powder metal. For instance, the ferromagnetic protective sleeve should be as thin as possible without sacrificing structural strength in order to occupy less volume and leave more volume available for powder metal. The ferromagnetic protective sleeve also may be preferably made from a material that responds well to grinding so that during manufacture a planar air gap surface 80 can be ground on the bottom face of stator assembly 20 to define an air gap 81, 82 separating the ferromagnetic protective sleeve 40 from an armature 70 of an armature assembly 12. In addition, the ferromagnetic protective sleeve might need to have geometry that allows it to be affixed to the stator core, such as by inclusion of a slot, that avoids abrasions and fragmentations of the stator core that could occur during assembly. In other words, the inclusion of a slot may not only improve performance incrementally by potentially reducing eddy currents, but also might allow the ferromagnetic protective sleeve to be slightly elastically deformed to slide easily into the stator core during assembly to avoid scraping and loss of material or breakage of the delicate powder metal of stator core 30, 130, 230.

In the embodiments of FIGS. 1-5, the ferromagnetic protective sleeve 40, 140 may provide a guide for a spring preload spacer and protect against potential electrical connection between an armature biasing spring 65 positioned inside of the sleeve 40, 140, and an solenoid housing 21, 121. Thus, the ferromagnetic protective sleeve according to the present disclosure may function as a portion of the stator with a lesser performance capability than if powder metal occupied the space, but the performance decrease is compensated for by protection of the powder metal stator core 30, 130, 230 against fragmentation and erosion especially in the area of the inner pole portion of the stator. Finally, the structure shown may allow the armature assembly preload spring 65 to provide a continuous force to help hold the ferromagnetic protective sleeve 40, 140 in place against the inner end face 31 of the powder metal stator core 30, 130.

During assembly, a cylinder 41 of the ferromagnetic protective sleeve 40 is fitted into the central bore 35 of the stator core 30 until a disk 42 of the ferromagnetic protective sleeve 40 contacts an inner end face 31 of the stator core 30. An armature biasing spring 65 is electrically isolated from the stator housing 121 by the poor electrical conductivity of the stator core 30 and an electrical isolation cavity 60 that separates the ferromagnetic protective sleeve 40 from contact with the stator housing 21. An outer end face 33 of the stator core may be covered by a flux ring to protect against having an outer pole surface exposed on the stator core. Like the protective sleeve 40, the flux ring 50 may not carry magnetic flux as well as powder metal, but may respond better to grinding operations and presents little to no risk of fragmentation or erosion that might otherwise occur if the flux ring were replaced by more powder metal.

The various components may be configured so that magnetic flux line 16 around the coil 52 pass through the stator core 30, the ferromagnetic protective sleeve 40, the armature 70, the flux ring 50 and back to the stator core 30. The ferromagnetic protective sleeve 40 may be affixed to the stator core 30 by forming plastic onto an annular knurled surface 45 of the ferromagnetic protective sleeve 40 and a retention ledge 34 of stator core 30. This plastic forming may occur after the sleeve 40 and stator core 30 assembled as shown in FIG. 1. The plastic may be injected through an access opening, (not shown) in stator housing 21, prior to the stator assembly 20 being positioned in actuator housing 13. Alternatively the plastic 59 may be molded before stator core 30 and sleeve 40 are positioned in housing 21. An air gap 81, 82 between armature 70 and ferromagnetic protective sleeve 40 may be set by choosing an appropriately height air gap spacer 58 as discussed earlier. In addition, the preload of armature biasing spring 65 may be set by choosing an appropriately sized spring preload spacer 66. Finally, the stator core may be protected against virtually all erosion by fuel and potential fragmentation by vibrations and the like by encapsulating the stator core 30 with at least the stator housing 21, the ferromagnetic protective sleeve 40, the bobbin 53 and the flux ring 50.

It should be understood that the above description is intended for illustrative purposes only, and is not intended to limit the scope of the present disclosure in any way. For instance, electrical isolation of the ferromagnetic protective sleeve 40 from the solenoid housing 21 can be accomplished with plastic 59 and/or a ceramic disc 150 or neither without departing from the present disclosure. Thus, those skilled in the art will appreciate that other aspects of the disclosure can be obtained from a study of the drawings, the disclosure and the appended claims.

What is claimed is:

1. A solenoid stator assembly comprising:

a housing defining an inner cavity that opens through one end along a centerline of the housing;

a stator core of formed powder metal fitted completely into the inner cavity and including an inner end face contiguous to a cylindrical wall concentric with the centerline;

a ferromagnetic protective sleeve with a surface in contact with the inner end face and the cylindrical wall;

a flux ring positioned in the housing in contact with an outer end face of the of the stator core a solenoid coil wound on a bobbin and positioned in the stator core; and wherein a magnetic flux line around the coil passes through the stator core, the ferromagnetic protective sleeve and the flux ring.

2. The solenoid stator assembly of claim 1 wherein the ferromagnetic protective sleeve, the housing and the stator core define an electrical isolation cavity; and the electrical isolation cavity separating the ferromagnetic protective sleeve from contact with the housing.

3. The solenoid stator assembly of claim 2 wherein the ferromagnetic protective sleeve includes an annular knurled surface partially defining the electrical isolation cavity; and plastic molded into the electrical isolation cavity in contact with a retention ledge of the stator core and the annular knurled surface of the ferromagnetic protective sleeve.

4. The solenoid stator assembly of claim 3 wherein the stator core is encapsulated by at least the housing, the flux ring, the bobbin and the ferromagnetic protective sleeve.

5. The solenoid stator assembly of claim 2 wherein the one end of the housing, the flux ring and the ferromagnetic protective sleeve define a planar air gap surface oriented perpendicular to the centerline.

6. The solenoid stator of claim 1 wherein the ferromagnetic protective sleeve defines a slot to spring fit the ferromagnetic sleeve into the stator core.

7. The solenoid stator of claim 1 wherein the cylindrical wall of the stator core defines a central bore; and the ferromagnetic protective sleeve defining a central cavity concentric with the centerline.

8. A solenoid actuator comprising:

a stator assembly including a stator core of formed powder metal received in a stator housing, and a ferromagnetic protective sleeve in contact with and covering a majority of an inner end face and a cylindrical wall of the stator core, a flux ring in contact with and covering an outer end face of the stator core, and a solenoid coil positioned in the stator core;

an armature assembly including an armature attached to a stem and movable between an initial air gap and a final air gap relative to the ferromagnetic protective sleeve;

a spring operably positioned in the ferromagnetic protective sleeve but electrically isolated from the stator housing; and wherein a magnetic flux line around the coil passes through the stator core, the ferromagnetic protective sleeve, the armature, the flux ring and back to the stator core.

9. The solenoid actuator of claim 8 wherein the spring is in contact with the ferromagnetic protective sleeve but electrically isolated from the stator housing by the stator core and an electrical isolation cavity defined by the ferromagnetic protective sleeve, the housing and the stator core.

10. The solenoid actuator of claim 9 wherein a portion of the electrical isolation cavity is defined by an annular knurled surface of the ferromagnetic protective sleeve and a retention ledge of the stator core; and plastic molded into the electrical isolation cavity in contact with the retention ledge and the annular knurled surface.

11. The solenoid actuator of claim 10 wherein the stator core is encapsulated by at least the stator housing, the flux ring, a bobbin and the ferromagnetic protective sleeve.

12. The solenoid actuator of claim 11 wherein one end of the housing, the flux ring and the ferromagnetic protective sleeve define a planar air gap surface facing a planar surface of the armature.

13. The solenoid actuator of claim 12 including an air gap spacer in contact with the stator assembly and a body with a guide bore; and the stem being guided in the guide bore.

14. The solenoid actuator of claim 13 and a spring preload spacer in contact with the ferromagnetic protective sleeve and the spring within the ferromagnetic protective sleeve.

15. The solenoid actuator of claim 14 including an actuator housing surrounding the solenoid assembly and threaded to the body with the air gap spacer clamped therebetween.

16. A method of assembling a solenoid actuator, comprising the steps of:

fitting a cylinder of a ferromagnetic protective sleeve into a central bore of stator core of formed powder metal until a disk of the ferromagnetic protective sleeve contacts an inner end face of the stator core;

electrically isolating an armature biasing spring from a stator housing with the stator core and an electrical isolation cavity separating the ferromagnetic protective sleeve from contact with the stator housing;

covering an outer end face of the stator core with a flux ring; and configuring the solenoid actuator so that a magnetic flux lines around the coil passes through the stator core, the ferromagnetic protective sleeve, the armature and the flux ring and back to the stator core.

17. The method of claim 16 including a step of affixing the ferromagnetic protective sleeve to the stator core by forming plastic onto an annular knurled surface of the ferromagnetic protective sleeve and a retention ledge of the stator core in the electrical isolation cavity.

18. The method of claim 17 including attaching an armature to a stem;

setting an air gap between the armature and the ferromagnetic protective sleeve with an air gap spacer; and setting a preload of the armature biasing spring with a preload spacer positioned in the ferromagnetic protective sleeve.

19. The method of claim 18 including protecting the stator core against erosion by fuel by encapsulating the stator core with at least the stator housing, the ferromagnetic protective sleeve, a bobbin and the flux ring.

20. The method of claim 19 including a step of guiding movement of the armature and the stem with a guide bore defined by a body; and clamping the air gap spacer between the body and the stator housing by threading an actuator housing to the body.

* * * * *